US007350755B1

(12) United States Patent
Harrison

(10) Patent No.: US 7,350,755 B1
(45) Date of Patent: Apr. 1, 2008

(54) WATERCRAFT ACCESSORY TOWER MOUNT

(76) Inventor: Robert W. Harrison, 5844 Los Molinos Dr., Buena Park, CA (US) 90620

( * ) Notice: Subject to any disclaimer, the term of this patent is extended or adjusted under 35 U.S.C. 154(b) by 0 days.

(21) Appl. No.: 11/201,923

(22) Filed: Aug. 9, 2005

(51) Int. Cl.
*A47B 96/06* (2006.01)

(52) U.S. Cl. ..... 248/230.6; 248/230.5; 248/214; 248/323; 248/231.71; 248/229.25; 248/226.11; 248/222.52; 248/231.61

(58) Field of Classification Search ..... 248/230.6, 248/230.1, 231.71, 229.25, 226.11, 230.5, 248/534, 222.52, 214, 231.61, 316.1, 316.6, 248/323, 327; 114/247, 235, 253, 242; 403/43, 403/46, 127, 164
See application file for complete search history.

(56) References Cited

U.S. PATENT DOCUMENTS 3,023,990 A * 3/1962 Gunthel, Jr. ..... 248/70
4,901,970 A * 2/1990 Moss et al. ..... 248/514
4,941,481 A * 7/1990 Wagenknecht ..... 606/59
6,505,573 B1 * 1/2003 Sheikholeslam et al. .... 114/254
6,672,238 B2 1/2004 Sheikholeslam
6,719,255 B2 * 4/2004 Chen ..... 248/323
6,776,116 B2 * 8/2004 Murphy et al. ..... 114/253
7,150,578 B2 * 12/2006 Porco ..... 403/60
2004/0238714 A1 * 12/2004 Slatter et al. ..... 248/534

* cited by examiner

*Primary Examiner*—Brian E. Glessner
*Assistant Examiner*—Todd M. Epps
(74) *Attorney, Agent, or Firm*—Dennis W. Beech

(57) ABSTRACT

The watercraft accessory tower mount may be used for attachment of watercraft accessories to a watercraft tower structure. A clamp bracket may be attachable to a clamp base. An accessory attachment may have a rotational shaft disposed for insertion in a rotational aperture of the clamp base. An attachment device may be used to rotatably attach the rotational shaft to the clamp base.

5 Claims, 2 Drawing Sheets

WATERCRAFT ACCESSORY TOWER MOUNT

BACKGROUND OF THE INVENTION

This invention relates to devices used to attach watercraft accessories, such as, lights, speakers, wakeboard racks, tow lines and the like, to watercraft or boat towers, overhead tubular bars and the like. The new tower mount may be attached to a boat tower provided for accessory attachment and allow 360 degree rotation of the accessory. The tower mount may also provide for connection to the boat electrical power or other wiring in the boat tower without using exposed wiring.

Various tower mounts may currently be used for accessories that may allow attachment to boat towers. Such tower mounts may not allow simple rotation of an accessory such as a light to orient it in various directions. The wiring for connecting between an accessory and the boat tower may also be exposed rather than routed interior to the tower mount.

SUMMARY OF THE INVENTION

The present invention is directed to devices for attachment of watercraft accessories to a watercraft tower structure. A clamp bracket may be attachable to a clamp base. An accessory attachment may have a rotational shaft disposed for insertion in a rotational aperture of the clamp base. An attachment device may be used to rotatably attach the rotational shaft to the clamp base.

These and other features, aspects and advantages of the present invention will become better understood with reference to the following drawings, description and claims.

DETAILED DESCRIPTION

The following detailed description represents the best currently contemplated modes for carrying out the invention. The description is not to be taken in a limiting sense, but is made merely for the purpose of illustrating the general principles of the invention.

Figure 1:
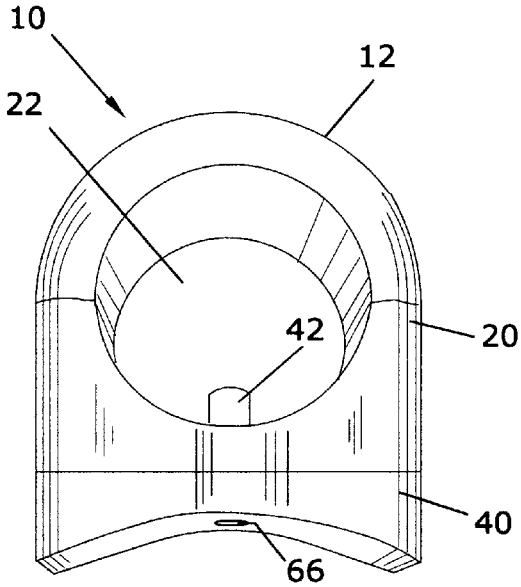
FIG. 1 illustrates a side perspective view of the tower mount according to an embodiment of the invention.
Figure 2:
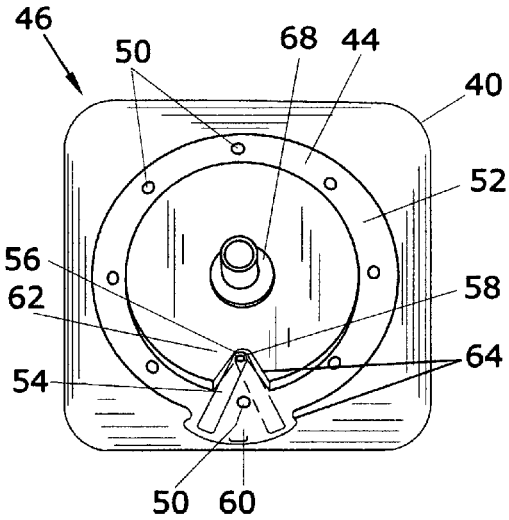
FIG. 2 illustrates a perspective plan view of the rotational side of the accessory attachment according to an embodiment of the invention.
Figure 3:
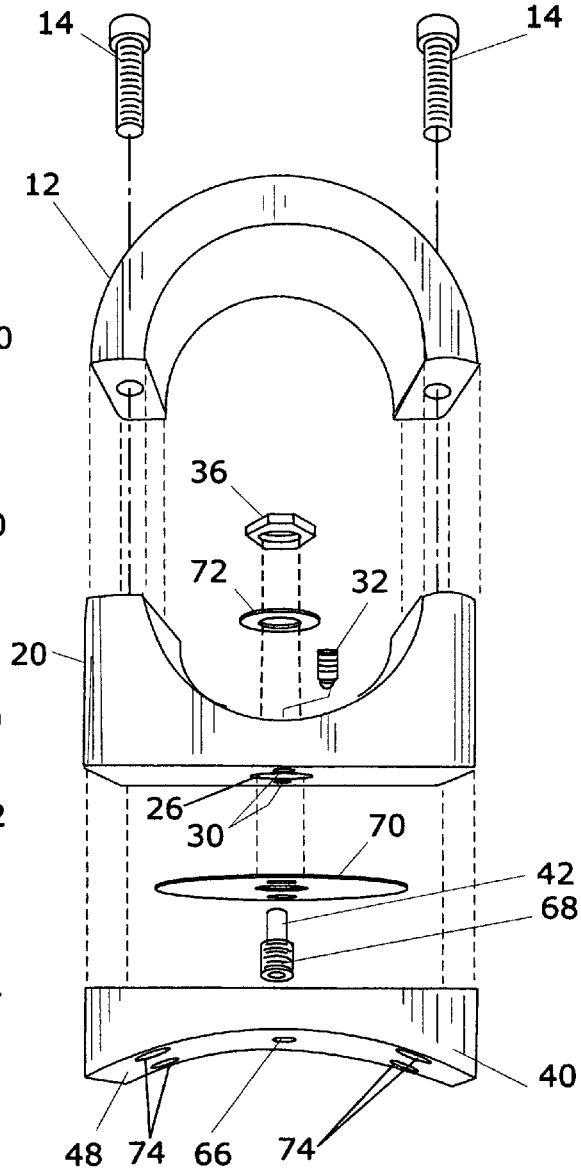
FIG. 3 illustrates a side perspective exploded view of the tower mount according to an embodiment of the invention.
Figure 4:
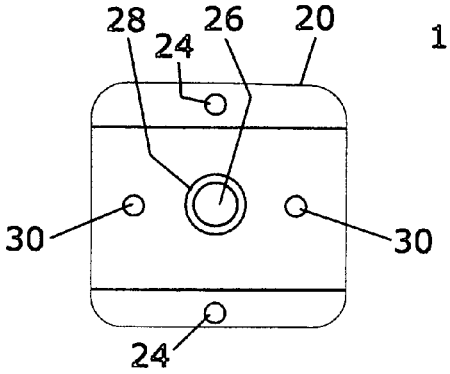
FIG. 4 illustrates a plan view of the clamp base according to an embodiment of the invention.
Figure 6:
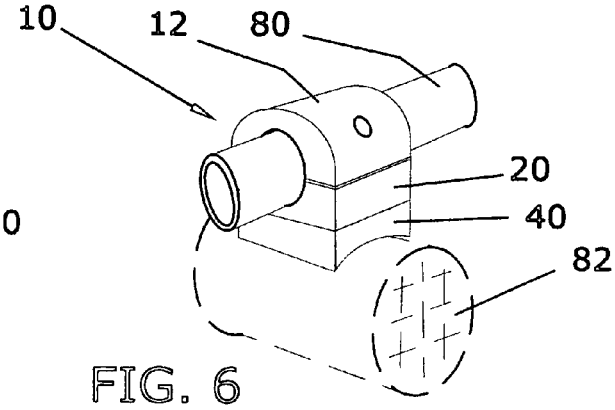
FIG. 6 illustrates a perspective elevation view of a tower mount attached to a boat tower according to an embodiment of the invention.
Figure 5:
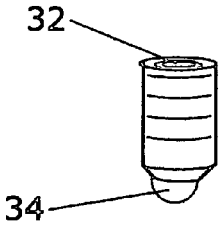
FIG. 5 illustrates a perspective view of a set screw according to an embodiment of the invention.
Figure 7:
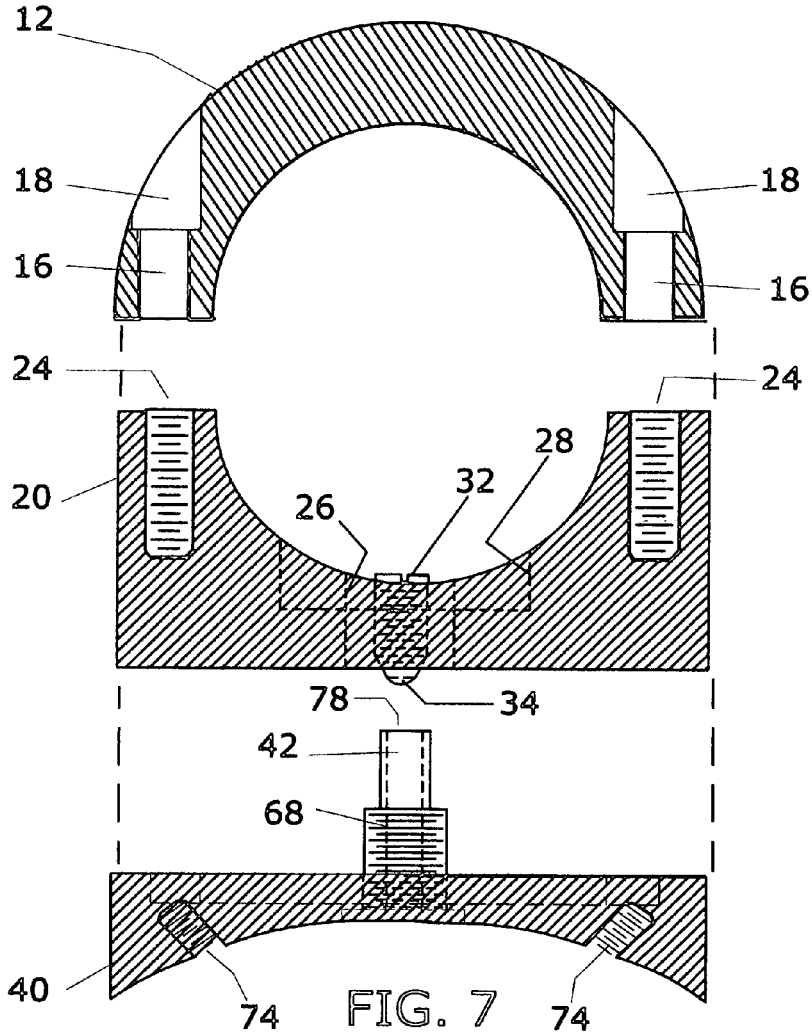
FIG. 7 illustrates a side cross sectional view of elements of the tower mount according to an embodiment of the invention.

Referring to FIGS. 1 and 6, a watercraft accessory tower mount 10 may have a clamp bracket 12 attached to a clamp base 20 to form a generally circular opening 22 for attachment on a boat tower 80 that may be tubular in construction. An accessory attachment 40 may be rotationally attached to the clamp base 20 opposite the clamp bracket 12. There may be a tower mount shaft element 42 for insertion interior to the boat tower 80 that may be used to route electrical wiring to an accessory and may prevent rotation of the tower mount 10 about the boat tower 80.

Other shapes of the opening 22 may be constructed for boat towers 80 that may have forms that may not be circular in cross section, for example, rectangular, triangular, oval or other cross sectional forms of boat towers 80. The attachment of the tower mount 10 in FIG. 6 disposes the accessory attachment 40 at the bottom of the tower mount 10. An accessory device 82 may be attached to hang from the boat tower 80. Other mount orientations may also be used depending on the requirement of the orientation of the accessory. For example, the tower mount 10 may be rotated 180 degrees for attachment to the boat tower 80 with the accessory attachment 40 positioned upwardly or at the top of the tower mount 10.

Referring to FIGS. 1 through 7, the tower mount 10 may have clamp bolts 14 for insertion through clamp bores 16 to be threadably engaged with threaded holes 24 in clamp base 20 for attachment to the clamp base 20. Clamp bores 16 may have clamp recesses 18. The clamp base 20 may have a generally centrally disposed rotational aperture 26 that may also have a generally circular attachment recess 28 on the clamp side of the clamp base 20. There may be one or more set screw apertures 30 for threadable engagement of a set screw 32 in the clamp base 20 to be positioned with a spring biased ball tip 34 in a groove 44 in accessory attachment 40.

The accessory attachment 40 may have a rotational side 46 and an attachment side 48 that may be generally opposed sides of the accessory attachment 40. The rotational side 46 may have groove 44 formed therein that may be generally circular in form. There may be detents 50 spaced apart in the base 52 of the groove 44. The detents 50 may be disposed radial approximately 45 degrees apart. When the accessory attachment may be rotationally attached to the clamp base 20, the spring ball tip 34 of the set screw 32 may serve to retain the clamp base 20 and accessory attachment 40 in a set position relative to each other when the spring ball tip 34 may be disposed in one of the detents 50.

There may be an arm 54 disposed at a rotational end 56 on a pin 58 in a pin hole disposed in a limit recess 60 of the rotational side 46. The limit recess 60 may be generally triangular in shape with pin 58 disposed in the proximal apex 62 of the limit recess 60 relative to the center of the accessory attachment 40. The arm 54 may allow rotation of the set screw 32 in the groove 44 until the arm 54 may be forced against a side 64 of the limit recess 60. This may allow a full 360 degree rotation between the clamp base 20 and the accessory attachment 40, and allow the spring ball tip 34 to be disposed in the detent 50 located in the limit recess 60. The arm 54 may also limit the rotation to approximately 360 degrees.

The accessory attachment 40 may have a threaded shaft bore 66 centrally disposed through the rotational side 46 and attachment side 48. A threaded rotational shaft 68 may be threadably engaged in shaft bore 66 with a shaft element 42 protruding above the rotational side 46. The rotational shaft 68 may be inserted through rotational aperture 26 in clamp base 20 to be secured by an attachment element, such as a nut 36. To facilitate rotation of the accessory attachment 40 relative to the clamp base 20 a washer 70 that may be of TEFLON material or other low friction composition may be disposed between the accessory attachment 40 and clamp base 20. The rotational shaft 68 may have a central bore 78 for routing electrical wiring between an accessory device 82 and the boat tower 80.

There may be a nut washer 72 of low friction material disposed between the nut 36 and attachment recess 28 to facilitate rotation of the accessory attachment 40. There may be accessory attachment holes 74 disposed in the attachment side 48 of the accessory attachment 40. The attachment side 48 may be generally semicircular concave in form as illustrated or may be flat or other shape depending on the configuration of accessory device 82 to be attached.

While the invention has been particularly shown and described with respect to the illustrated embodiments thereof, it will be understood by those skilled in the art that the foregoing and other changes in form and details may be made therein without departing from the spirit and scope of the invention.

I claim:

1. A device for attachment of watercraft accessories to a watercraft tower structure comprising:

a clamp bracket attachable to a clamp base;

an accessory attachment having a rotational shaft disposed for insertion in a rotational aperture of said clamp base wherein said accessory attachment having a threaded bore centrally disposed therein for threadable insertion of said rotational shaft;

said rotational shaft extending outwardly from a rotational side of said accessory attachment and having a shaft element at a distal end;

said clamp base having an attachment recess therein circumferentially disposed around said rotational aperture and a nut threadably engaged on said rotational shaft with a nut washer of low friction material composition disposed between said nut and said attachment recess;

said accessory attachment having an annular groove in a rotational side thereof;

said annular groove having a plurality of detents formed in a base thereof;

said clamp base having a set screw aperture therein for threadable insertion of a set screw disposed for a spring ball tip of said set screw to be positioned in one of said plurality of detents;

said annular groove having a limit recess formed in a portion thereof wherein said limit recess is approximately triangular in shape;

said limit recess having a pin hole therein disposed in a proximal apex with a pin inserted in said pin hole and an arm rotatable disposed at a rotational end on said pin; and rotational motion of said arm about said pin is limited by a side of said limit recess and said arm disposed to limit motion of said set screw in said annular groove.

2. The device as in claim 1 wherein a washer of low friction material composition is disposed on said rotational shaft intermediate said clamp base and said rotational side.

3. The device as in claim 1 wherein said accessory attachment having an attachment side generally opposed a rotational side and said attachment side having a plurality of accessory attachment holes therein.

4. The device as in claim 1 wherein said clamp base is generally semicircular in shape and said clamp base having a plurality of clamp bores with clamp recesses formed therein for receipt of a clamp bolt to be threaded into said clamp base having a plurality of threaded holes therein.

5. The device as in claim 1 wherein said rotational shaft having a central bore therein.

* * * * *